US008256533B2

(12) United States Patent
Blangé

(10) Patent No.: US 8,256,533 B2
(45) **Date of Patent: *Sep. 4, 2012**

(54) DISTANCE HOLDER WITH HELICAL SLOT

(75) Inventor: Jan-Jette Blangé, Rijswijk (NL)

(73) Assignee: Shell Oil Company, Houston, TX (US)

( * ) Notice: Subject to any disclaimer, the term of this patent is extended or adjusted under 35 U.S.C. 154(b) by 55 days.

This patent is subject to a terminal disclaimer.

(21) Appl. No.: 12/531,500

(22) PCT Filed: Mar. 20, 2008

(86) PCT No.: PCT/EP2008/053341

§ 371 (c)(1),
(2), (4) Date: Sep. 16, 2009

(87) PCT Pub. No.: WO2008/113844

PCT Pub. Date: Sep. 25, 2008

(65) Prior Publication Data

US 2010/0108389 A1 May 6, 2010

(30) Foreign Application Priority Data

Mar. 22, 2007 (EP) ..... 07104677

(51) Int. Cl.
*E21B 7/16* (2006.01)

(52) U.S. Cl. ..... 175/54; 175/67; 175/393; 175/424

(58) Field of Classification Search ..... 175/424, 175/67, 54, 393

See application file for complete search history.

(56) References Cited

U.S. PATENT DOCUMENTS

| | | | | |
|---|---|---|---|---|
| 1,502,851 | A * | 7/1924 | Gale | 175/54 |
| 3,838,742 | A | 10/1974 | Juvkam-Wold | 175/380 |
| 3,838,745 | A | 10/1974 | Kappei | 180/68.5 |
| 5,199,512 | A | 4/1993 | Curlett | 175/67 |
| 5,887,667 | A * | 3/1999 | Van Zante et al. | 175/67 |
| 6,397,959 | B1 * | 6/2002 | Villarreal | 175/393 |
| 7,017,684 | B2 * | 3/2006 | Blange | 175/424 |
| 7,083,011 | B2 * | 8/2006 | Meyer | 175/424 |
| 2006/0027398 | A1 | 2/2006 | Tibbitts et al. | 175/54 |
| 2010/0084195 | A1 * | 4/2010 | Blange | 175/393 |

FOREIGN PATENT DOCUMENTS

| | | |
|---|---|---|
| WO | WO9204528 | 3/1992 |
| WO | WO2005040546 | 5/2005 |

* cited by examiner

*Primary Examiner* — Giovanna Wright
*Assistant Examiner* — Richard Alker

(57) ABSTRACT

A distance holder for connection to, and rotation with, a drill string in an earth formation drilling device arranged to supply a jet of abrasive fluid for the purpose of providing a borehole by removing earth formation material through abrasion, comprises a housing with a chamber which is essentially rotational symmetric and which is to face the earth formation material, and a jet nozzle which arranged for discharging a jet of the abrasive fluid in the chamber, the housing comprising at least one slot for allowing the abrasive fluid to leave the chamber. The slot is continued over the housing outer surface so as to counteract rolling motions of the particles which are comprised in the abrasive fluid.

12 Claims, 4 Drawing Sheets

DISTANCE HOLDER WITH HELICAL SLOT

PRIORITY CLAIM

The present application claims priority from PCT/EP2008/053341, filed 20 Mar. 2008, which claims priority from EP Application 07104677.5, filed 22 Mar. 2007.

BACKGROUND OF THE INVENTION

The invention is related to a distance holder for connection to, and rotation with, a drill string in an earth formation drilling device arranged to supply a jet of abrasive fluid for the purpose of providing a borehole by removing earth formation material through abrasion, comprising a housing with a chamber which is essentially rotational symmetric and which is to face the earth formation material, and a jet nozzle which arranged for discharging a jet of the abrasive fluid in said chamber, said housing comprising at least one slot for allowing the abrasive fluid to leave the chamber.

Such a distance holder is disclosed in WO-A-2005/040546. By means of an earth formation drilling device which is equipped with a distance holder of this type, the borehole bottom is abraded by the abrasive particles comprised in the abrasive fluid which is discharged at high velocity. Due to the orientation of the jet nozzle, a cone is formed on the borehole bottom. The abrasive fluid hits said cone, abrading it further and further. The fluid is discharged from the chamber through the slot, and subsequently the fluid is urged to flow upwardly along the outside of the distance holder into the annulus between the drill string and the borehole wall. By means of a magnet contained in the earth drilling device, the abrasive particles are extracted from the fluid and fed back to the jet nozzle for further abrasive action.

However, the shape of the cone and the way in which the fluid hits said cone, may impair the extraction of steel abrasive particles. The steel abrasive particles show the tendency to roll along the slope of the cone formed on the borehole bottom. The rotational speed of these steel abrasive particles may well exceed 60,000 rpm in this way. The steel abrasive particles continue to rotate at this high rotational speed while travelling upwardly along the earth drilling device and in particular along the part thereof containing the magnet.

The rotation of the particles has a tangential orientation. The contacts of the rolling particle with the borehole wall further induces the rotational effect with tangential orientation. Said rotation of an abrasive particle that contains ferromagnetic and electrically conducting material reduces the penetration of a magnetic field into the particles. This causes a reduction of the magnetic force exerted by the magnetic separator onto the steel abrasive particles. For instance, in the case of steel abrasive particles with a diameter of 1 mm, the loss of magnetic attraction becomes significant. The combination of upward particle velocity and rotational particle speed at the position of the magnetic separator makes the magnetic field generated by the magnetic separator less effective. Consequently, extraction of the steel abrasive particles from the fluid is impaired.

SUMMARY OF THE INVENTION

The object of the invention is therefore to provide a distance holder of the type described before which provides a better extraction of the steel abrasive particles. Said object is achieved in that slot is continued over the housing outer surface.

The continuation of the slot over the outside of the housing has several effects. Such slot first of all may impose a flow path that is different from the flow path that is oriented vertically upwardly. Instead the steel abrasive particles, which collide with the borehole wall and the slot walls, may now be subjected to rotational impulses of a different orientation than a tangential orientation. In that case, such rolling effect with tangential orientation will not be promoted but will be decreased.

Additionally, the path of travel of the steel abrasive particles will generally become longer, depending on the shape selected for the slot. Thereby, the rotating steel abrasive particles will be subjected for a longer time period to the decelerating drag effect of the fluid, which further reduces the rotational speed thereof.

In practice, the invention can be carried out in several ways. In case the housing comprises a skirt at its axially outermost, the slot is provided in said skirt. The slot then extends over the outside of the skirt. In a preferred embodiment, the slot extends helically over the outer surface of the skirt. Thereby, a dominant helical flow of the fluid and steel particles is obtained, in combination with a relatively long way of travel of said particles before reaching the magnetic separator. This furthermore promotes the slowdown of the rotation and velocity of the steel abrasive particles, and thereby an improved extraction effect of the magnetic separator. After the rolling steel abrasive particles hit the borehole bottom, they move radially outwardly. By means of the slot, the flow is bending into the circumferential direction.

The rotational speed and velocity of the steel abrasive particles can be further reduced, at the location of the magnetic separator, in case the kirt has outer cross sectional dimensions which are larger than the outer cross sectional dimensions of the housing part adjoining said skirt. The fluid flow, after leaving the slot, is then entering a relatively wide space. This transfer to a relatively wide space brings a reduction of the velocity, which is beneficial for extracting the steel abrasive particles from the fluid flow. Preferably, the skirt is provided with a deflector positioned in the path of the fluid jet discharged from the jet nozzle. By means of such deflector, the fluid can be promoted to flow into the direction of the slot.

In this connection, the orientation of the deflector is of importance. The effect of the deflector is enhanced in case said deflector, when seen in circumferential direction, extends between an end adjoining the skirt and an end adjoining the slot. Moreover, preferably the skirt has an outer surface and an inner surface, and the distance of the deflector near or at the end adjoining the skirt to the axis of rotation is approximately the same as the radius of the slot inner surface and the distance of the defector at or near the end adjoining the slot has a distance to the axis of rotation which is approximately the same as the radius of the slot outer surface.

Furthermore, the size of the deflector, when seen in circumferential direction, may be approximately the same as the width of the abrasive fluid jet at the position of the deflector and issued by the jet nozzle. Such dimension is appropriate for deflecting the full abrasive jet in the desired direction.

BRIEF DESCRIPTION OF THE DRAWINGS

The invention will further be described with reference to an example shown in the drawings.

DETAILED DESCRIPTION OF PREFERRED EMBODIMENTS

Figure 1:
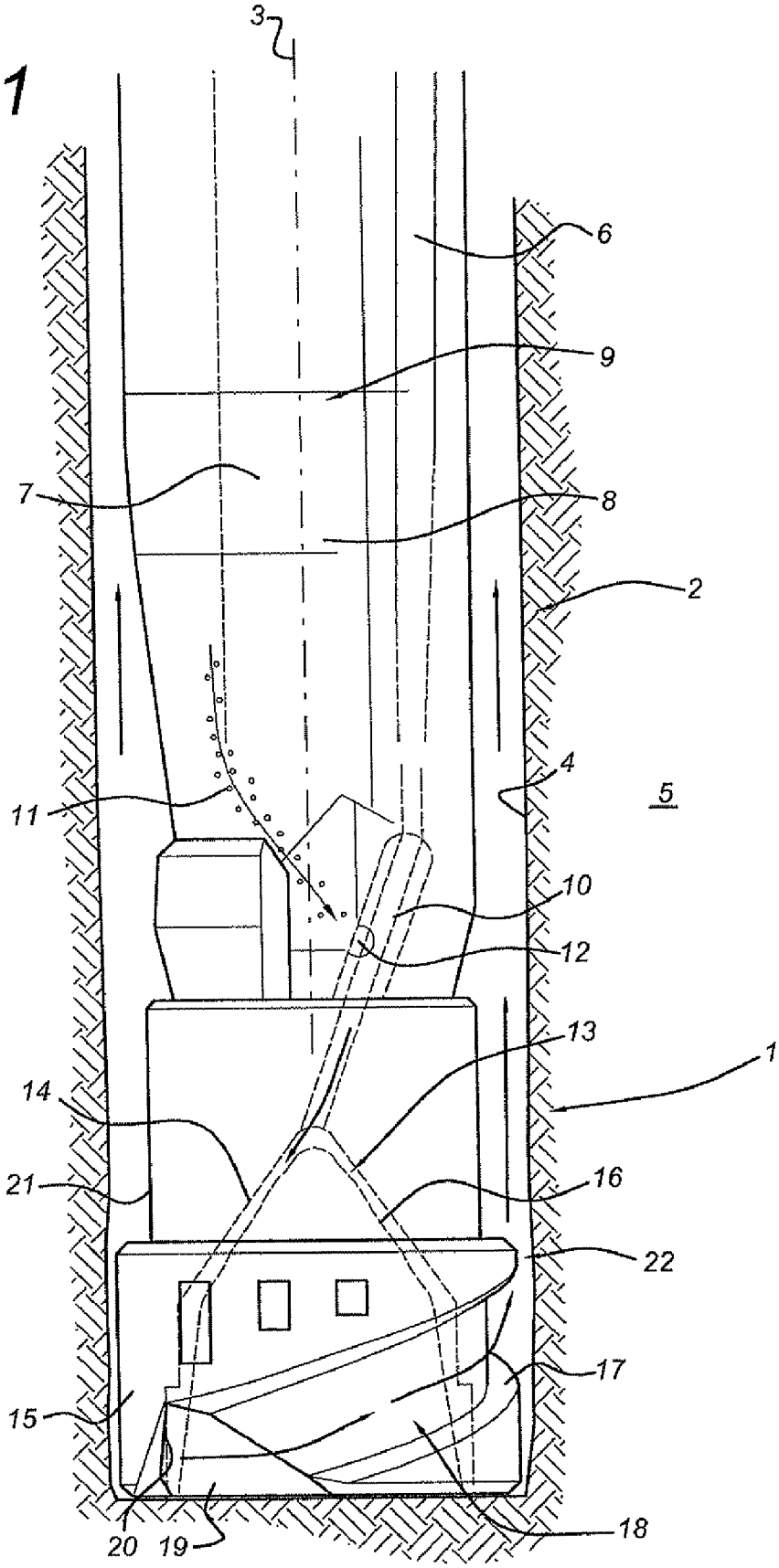
FIG. 1 shows a side view (partially taken away) of the earth drilling device according to the invention.
Figure 2:
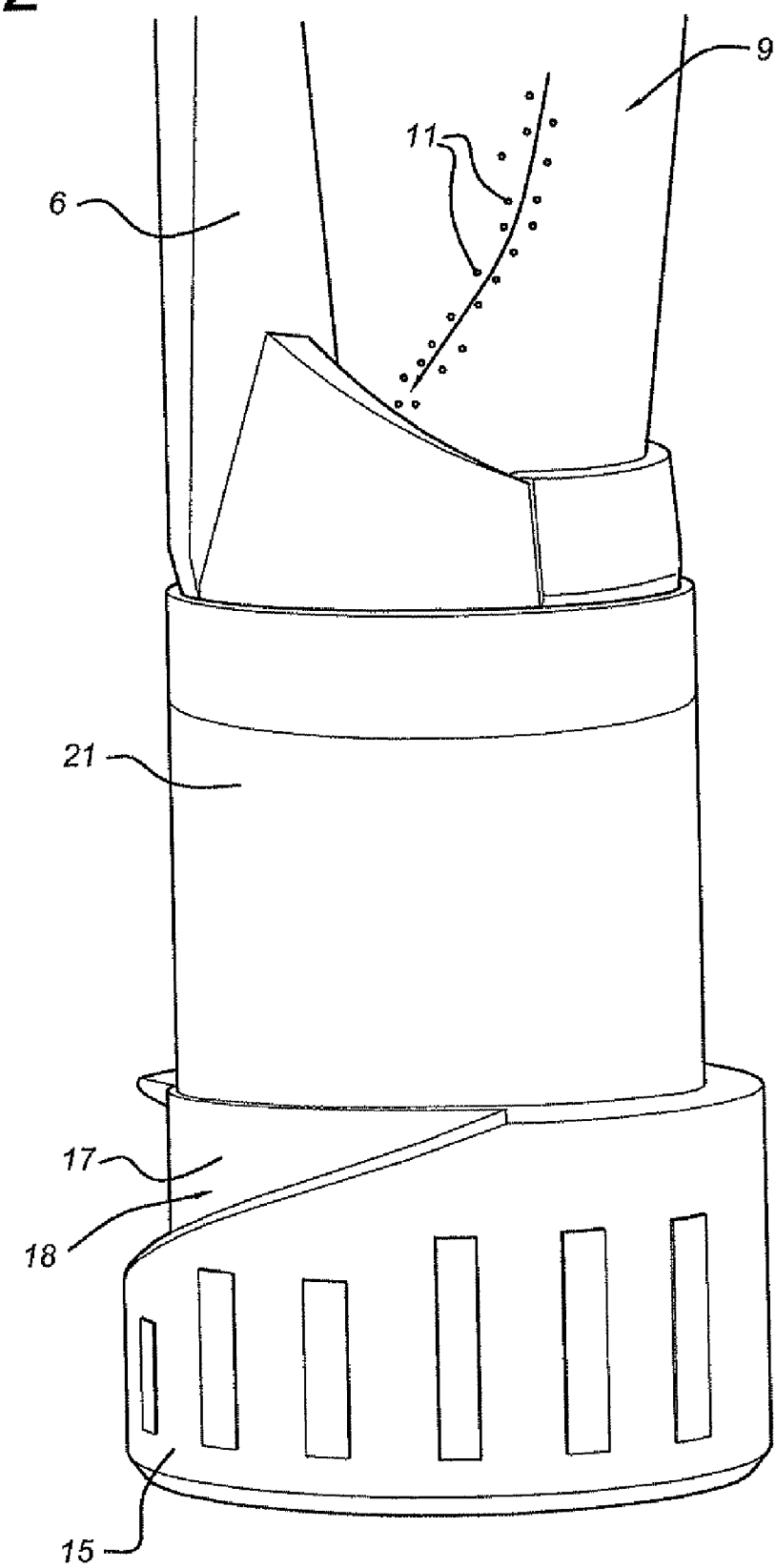
FIG. 2 shows the opposite side view.
Figure 3:
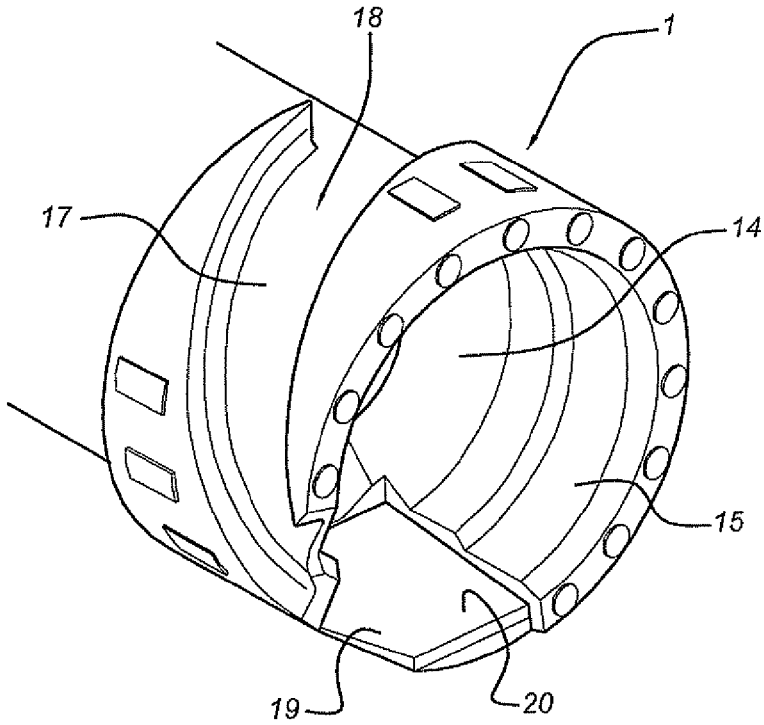
FIG. 3 shows a view in perspective from below of the distance holder.
Figure 4:
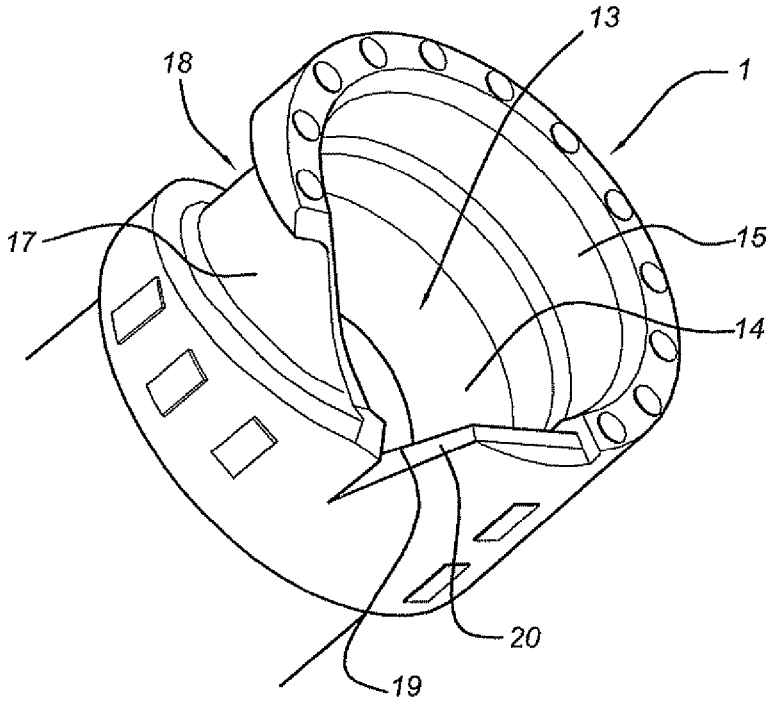
FIG. 4 shows another view in perspective of the distance holder.

The earth drilling device 2 as shown in FIGS. 1 and 2 is accommodated in a borehole 4 in an earth formation 5 and comprises a distance holder 1 and a drill string (not shown), which together are rotatable about an axis of rotation 3. Drill string 2 is suspended from a drilling rig at the surface of the earth formation 5, and comprises a pressure conduit 6 by means of which a drilling fluid is supplied to a jet nozzle 10, which is visible in the partially broken away view of FIG. 1. The drilling device furthermore comprises a magnetic separator 9 which consists of a magnet 7 contained in a magnet housing 8.

Steel abrasive particles 11 are extracted from the drilling fluid at the level of the magnetic separator 9. Under the influence of the magnetic field of magnet 7 of magnetic separator 9, the steel abrasive particles are attracted onto the surface of magnet housing 8. As a result of the shape of magnet housing 8, which tapers towards inlet 12 of jet nozzle 10, and the particular magnetic field as generated by magnet 7, the steel abrasive particles 11 on magnet housing 8 are drawn towards inlet 12 of jet nozzle 10. Subsequently said steel abrasive particles are sucked into said inlet by the underpressure which is generated in the throat of the jet nozzle by the high velocity fluid.

Figure 6:
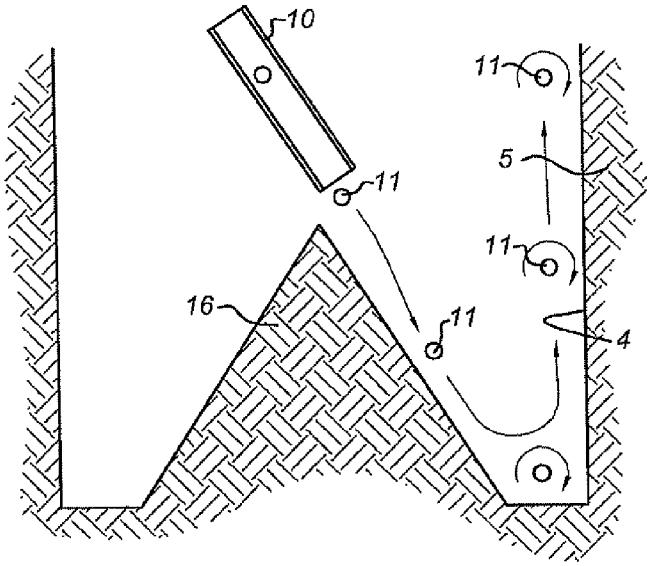
FIG. 6 shows a schematic view of abrasive particle rolling as occurring in prior art earth drilling devices.

Jet nozzle 10 discharges the drilling fluid mixed with steel abrasive particles in the chamber 13, in particular in the recess 23 thereof. The chamber 13 is accommodated in the distance holder housing 22 and has a trumpet-shaped upper part 14 and an essentially cylindrical skirt 15. The fluid/particle mixture generates a cone shaped downhole bottom 16. Thus, upon impact of the drilling fluid/particle mixture on the slope of the bottom cone 16 the particles 11 may obtain a rotation with an axis which is tangentially oriented in the downhole coordinate system. This effect is schematically shown in FIG. 6, from which the distance holder has been omitted. The speed of this rotation may well exceed 60,000 rpm. After attaining the lowest part of the bottom, the direction of the steel abrasive particles is reversed in upward direction whereby the tangential rotation plays a role as well.

When travelling further upwards, the rotating steel abrasive particles 11 reach the magnetic field as generated by magnetic separator 9. In prior art drilling devices, said field is unable to penetrate the steel abrasive particles as a result of the high rotational speeds thereof. Thus, extraction of the steel abrasive particles 11 from the fluid is less successful, resulting in the transport of large amounts of steel particles through the circulation system of the fluid. This however is quite undesirable, from a point of view of wear of the system. Moreover, the resulting lack of abrasive magnetic particles near the bottom negatively influences the forming of a hole.

Figure 5:
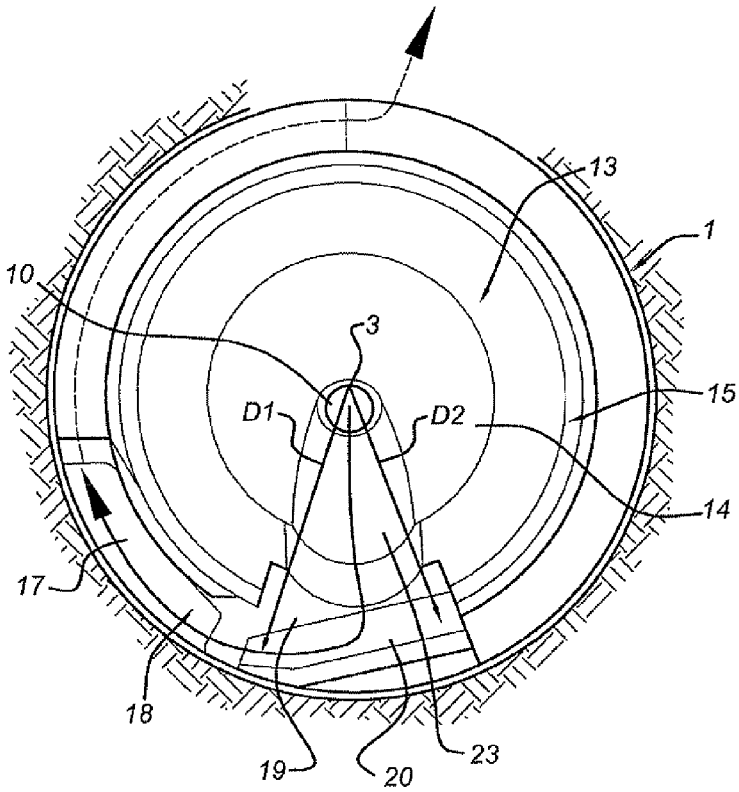
FIG. 5 shows a bottom view of the distance holder.

According to the invention therefore, means have been implemented which prevent the bypassing of high rotational velocity steel abrasive particles past magnetic separator 9. These means include a slot 18 having a helically shaped part 17, which slot 18 furthermore comprises a slot part 19 through which the fluid/particle mixture leaves chamber 13. After abrading the earth formation, said mixture reaches slot part 19 and is redirected toward helical slot part 17, as shown in FIGS. 1 and 5. This change of direction of the flow is promoted by the orientation of a deflector 20, such as a plate of tungsten carbide. The distance D1 of said deflector 20 at its side bordering the slot part 19 to the rotation axis 10 is larger than said distance D2 of said deflector 20 at its opposite side. The slanting orientation of the deflector 20 makes that the fluid/particle flow is diverted towards the slot 18, as shown in FIG. 5.

Along the flow path of slot 18, steel abrasive particles 11 collide with the walls bordering slot 18 as well as with the borehole wall 4. Thereby rotations are generated with an axis that is different from the original tangential rotation axis, as a result of which the overall rotational speed of the steel abrasive particles is reduced. Moreover, the length of the flow path of the steel abrasive particles from the cone 16 up to the magnetic separator 9 is increased appreciably. This means that the effect of slowing down the rotational speed of said particles is also increased as a result of drag forces generated by the fluid.

At the level of magnetic separator 9, the rotational speed of steel magnetic particles 11 has reached such a low magnitude that the extracting effect of the magnetic field of the magnetic separator is restored. This is also achieved by the overall decrease of the particle and fluid velocity that occurs as a result of the wider annulus at the level of the housing part 21 of distance holder housing 22. The outer diameter of housing part 21 is smaller than the diameter of skirt 15.

What is claimed is:

1. A distance holder for connection to, and rotation with, a drill string in an earth formation drilling device arranged to supply a jet of abrasive fluid for the purpose of providing a borehole by removing earth formation material through abrasion, comprising a housing with a chamber that is essentially rotationally symmetric and has a rotation axis and which faces the earth formation material, and a jet nozzle arranged for discharging a jet of the abrasive fluid in said chamber, said housing comprising at least one slot for allowing the abrasive fluid to leave the chamber, wherein the slot is continued over the outer surface of said housing, and wherein the housing at its axially outermost end comprises a skirt having an outer surface, the slot being provided in said skirt, wherein the slot extends helically on the outer surface of the skirt wherein the skirt is provided with a deflector positioned in the path of the fluid jet discharged from the jet nozzle; and wherein a distance from the side of said deflector bordering the slot to the rotation axis is larger than a distance from the opposite side of said deflector to the rotation axis, such that said deflector has a slanting orientation that diverts the fluid jet toward the slot.

2. The distance holder according to claim 1 wherein the slot comprises an interruption of the skirt, a helically extending part of the slot connecting to said interruption.

3. The distance holder according to claim 1 wherein the skirt has outer cross sectional dimensions that are larger than the outer cross sectional dimensions of a part of the housing adjoining said skirt.

4. The distance holder according to claim 3 wherein the helically extending part of the slot opens in the space delimited by the outer surface of the housing part adjoining the skirt.

5. The distance holder according to claim 1 wherein the deflector adjoins the slot.

6. The distance holder according to claim 1 wherein the deflector, when seen in circumferential direction, extends between an end adjoining the skirt and an end adjoining the slot.

7. The distance holder according to claim 1 wherein the deflector comprises at least one plate.

8. The distance holder according to claim 1 wherein the deflector comprises tungsten carbide.

9. The distance holder according to claim 1 wherein the chamber has a trumpet-shaped inner surface.

10. The distance holder according to claim 9 wherein the trumpet-shaped surface comprises a radially extending recess into which the jet nozzle discharges.

11. The distance holder according to claim 1 wherein the jet nozzle is oriented obliquely with respect to the axis of rotation for making the jet of abrasive fluid intersect the borehole axis.

12. A distance holder for connection to, and rotation with, a drill string in an earth formation drilling device arranged to supply a jet of abrasive fluid for the purpose of providing a borehole by removing earth formation material through abrasion, comprising:

a housing with a chamber that is essentially rotationally symmetric and which faces the earth formation material; and a jet nozzle arranged for discharging a jet of the abrasive fluid in said chamber, said housing comprising at least one slot for allowing the abrasive fluid to leave the chamber, wherein the slot is continued over the outer surface of said housing, and wherein the housing at its axially outermost end comprises a skirt having an inner surface and an outer surface, the slot being provided in said skirt, wherein the slot extends helically on the outer surface of the skirt;

wherein the skirt is with a deflector positioned in the path of the fluid jet discharged from the jet nozzle;

wherein the deflector, when seen in circumferential direction, extends between an end adjoining the skirt and an end adjoining the slot; and wherein the distance of the deflector near or at the end adjoining the skirt to the axis of rotation is approximately the same as the radius of an inner surface of the slot and the distance of the defector at or near the end adjoining the slot has a distance to the axis of rotation which is approximately the same as the radius of an outer surface of the slot.

* * * * *